US010799860B2

(12) United States Patent
Dudek et al.

(10) Patent No.: US 10,799,860 B2
(45) Date of Patent: Oct. 13, 2020

(54) SAMPLING PIPETTE COMPRISING A CONTROL MEMBER WITH DOUBLE FUNCTION FOR EJECTING A CONE AND UNLOCKING THE SYSTEM FOR VOLUME ADJUSTMENT

(71) Applicant: GILSON SAS, Villiers-le-Bel (FR)

(72) Inventors: Bruno Dudek, Orry-la-Ville (FR); Stéphane Guichardon, Bougival (FR)

(73) Assignee: GILSON SAS, Villiers-le-Bel (FR)

( * ) Notice: Subject to any disclaimer, the term of this patent is extended or adjusted under 35 U.S.C. 154(b) by 352 days.

(21) Appl. No.: 15/759,983

(22) PCT Filed: Sep. 14, 2016

(86) PCT No.: PCT/EP2016/071625
§ 371 (c)(1),
(2) Date: Mar. 14, 2018

(87) PCT Pub. No.: WO2017/046120
PCT Pub. Date: Mar. 23, 2017

(65) Prior Publication Data

US 2018/0250667 A1 Sep. 6, 2018

(30) Foreign Application Priority Data

Sep. 15, 2015 (FR) ..... 15 58650

(51) Int. Cl.
*B01L 3/02* (2006.01)

(52) U.S. Cl.
CPC ..... *B01L 3/0279* (2013.01); *B01L 3/0224* (2013.01); *B01L 3/0286* (2013.01); *B01L 2400/0487* (2013.01)

(58) Field of Classification Search
CPC ..... B01L 3/0279; B01L 3/0224; B01L 3/0286
See application file for complete search history.

(56) References Cited

U.S. PATENT DOCUMENTS 4,009,611 A * 3/1977 Koffer ..... B01L 3/0279 73/864.14
4,096,750 A * 6/1978 Sturm ..... B01L 3/0224 422/925

(Continued)

OTHER PUBLICATIONS

English translation of International Search Report for PCT/EP2016/071625, dated Oct. 20, 2016.

(Continued)

*Primary Examiner* — Brian R Gordon
(74) *Attorney, Agent, or Firm* — Pearne & Gordon LLP

(57) ABSTRACT

In order to improve the ergonomics of a sampling pipette, the invention provides a control member intended to occupy a nominal central position in which a spring brings a locking member into the locking position thereof of the system for adjustment of the volume to be sampled, the member being able to be axially displaced towards each of the two following positions: a low position for ejecting a cone, in which the control member presses on the cone ejector, the movement from the nominal central position to the low position being carried out against the springs; and a high position for unlocking the braking ring, the movement of the control member from the nominal central position to the high position driving a disengagement element to move the locking member against the spring, until release of the braking ring.

13 Claims, 8 Drawing Sheets

(56) References Cited

U.S. PATENT DOCUMENTS 4,096,751 A * 6/1978 Withers ..... B01L 3/0224 222/43
4,261,205 A * 4/1981 Oshikubo ..... B01L 3/0279 422/538
4,283,950 A * 8/1981 Tervamaki ..... B01L 3/0279 422/517
4,418,580 A * 12/1983 Satchell ..... B01L 3/0279 422/923
5,320,810 A * 6/1994 Al-Mahareeq ..... B01L 3/0224 422/517
5,413,006 A * 5/1995 D'Autry ..... B01L 3/0224 422/925
5,650,124 A * 7/1997 Gilson ..... B01L 3/0224 422/180
5,792,424 A * 8/1998 Homberg ..... B01L 3/0224 422/515
5,849,248 A 12/1998 Homberg
6,295,880 B1 * 10/2001 Gilson ..... B01L 3/0224 73/864.18
6,365,110 B1 * 4/2002 Rainin ..... B01L 3/0224 422/522
6,532,837 B1 * 3/2003 Magussen, Jr. ..... B01L 3/0279 73/864.01
2002/0041833 A1 * 4/2002 Telimaa ..... B01L 3/0224 422/516
2005/0039550 A1 * 2/2005 Uldry ..... B01L 3/0224 73/864.18
2005/0142038 A1 * 6/2005 Petrek ..... B01L 3/0224 422/516
2005/0175511 A1 * 8/2005 Cote ..... B01L 3/0279 422/522
2006/0096349 A1 * 5/2006 Czernecki ..... B01L 3/0224 73/1.74
2007/0056391 A1 * 3/2007 Karbowniczek ..... B01L 3/0279 73/864.14
2007/0199390 A1 * 8/2007 Viot ..... B01L 3/0227 73/864.18
2009/0211332 A1 * 8/2009 Telimaa ..... B01L 3/0224 73/1.74
2010/0266453 A1 * 10/2010 Rylski ..... B01L 3/0224 422/516
2011/0036185 A1 2/2011 Petrek
2011/0132110 A1 * 6/2011 Kimura ..... B01L 3/0224 73/864.01
2012/0148459 A1 * 6/2012 Sarna ..... B01L 3/0279 422/516
2013/0233095 A1 * 9/2013 Wilmer ..... B01L 3/0224 73/864.01
2013/0291660 A1 * 11/2013 Wilmer ..... B01L 3/0224 73/864.13
2014/0216579 A1 * 8/2014 Bemis ..... B01L 3/5085 137/565.23
2014/0242719 A1 * 8/2014 Heinonen ..... B01L 3/0224 436/180
2015/0209777 A1 * 7/2015 Petrek ..... B01L 3/0217 73/864.18
2016/0051978 A1 2/2016 Voyeux et al.
2016/0059229 A1 * 3/2016 Dudek ..... B01L 3/0227 422/509
2016/0199830 A1 * 7/2016 LaCroix ..... B01L 3/0217 73/864.13
2016/0228868 A1 * 8/2016 Sanchez ..... B01L 3/0224
2016/0271602 A1 9/2016 Voyeux et al.
2016/0303557 A1 * 10/2016 LaCroix ..... B01L 3/0224
2017/0001189 A1 * 1/2017 Hintikka ..... B01L 3/0279
2017/0028397 A1 2/2017 Dudek
2019/0083971 A1 * 3/2019 Schiraga ..... F16H 63/16
2019/0283016 A1 * 9/2019 Dobele ..... B01L 3/0217
2019/0366323 A1 * 12/2019 Dobele ..... B01L 9/543
2019/0374936 A1 * 12/2019 Dobele ..... B01L 3/0224

OTHER PUBLICATIONS

U.S. Appl. No. 15/739,012, titled "Improved Control Button for a Sampling Pipette," filed Jun. 21, 2016.
Search Report for French application No. FR 15 58650, dated Jun. 29, 2016.
Written Opinion of the International Search Authority for PCT/EP2016/071625 dated Mar. 23, 2017.

* cited by examiner

SAMPLING PIPETTE COMPRISING A CONTROL MEMBER WITH DOUBLE FUNCTION FOR EJECTING A CONE AND UNLOCKING THE SYSTEM FOR VOLUME ADJUSTMENT

This is a National Stage application of PCT international application PCT/EP2016/071625, filed on Sep. 14, 2016, which claims the priority of French Patent Application No. 1558650, filed Sep. 15, 2015, both of which are incorporated herein by reference in their entirety.

TECHNICAL FIELD

The invention relates to the field of sampling pipettes, also called laboratory pipettes or even liquid transfer pipettes, for sampling and dispensing liquid in containers or the like.

The pipettes concerned by the present invention are manually actuated pipettes. These pipettes are for being handheld by an operator during liquid sampling and dispensing operations, these operations being made by moving a pipetting control knob, achieved by applying an actuation pressure on the same knob.

STATE OF PRIOR ART for many years, designing manually actuated pipettes has been the subject of many improvements. These improvements aim in particular at simplifying pipette design, or even enhancing their ergonomics.

However, a manually actuated pipette remains relatively complex, in particular because of the presence of multiple controls among which the pipetting knob, a locking member used for blocking the sampling volume adjusting system, or even a cone ejection knob.

There remains a need for optimising the design of such pipettes, in particular for improving their ergonomics.

SUMMARY OF THE INVENTION

The purpose of the invention is thus to meet at least partially the above-identified need.

To do this, one object of the invention is a manually actuated sampling pipette comprising:

- a fixed pipette body;
- a pipetting control rod at the end of which a pipetting control knob is arranged;
- a cone ejector returned in a high position with respect to the fixed pipette body by first elastic return means;
- a sampling volume adjusting control screw;
- a braking ring for braking the control screw, rotatably integral with the same.

According to the invention, the pipette further includes a dual function control member allowing an unlocking control of the braking ring and a cone ejection control, the control member being slidingly mounted relative to the fixed pipette body about an axial direction of the pipette, this including a locking member for locking the braking ring, second elastic return means returning the locking member into a locking position in which this locking member cooperates with the braking ring in order to brake the rotation thereof, and following means for following the axial movement of the dual function control member, these following means including a disengagement element for disengaging the locking member, said pipette being configured such that the control member can occupy a nominal central position in which said second elastic return means bring the locking member into its locking position, and can be axially moved, from its nominal central position, to each of the two following positions:

- a low cone ejection position, in which the control member presses the cone ejector, the movement from the nominal central position to the low cone ejection position being made against the strain exerted by said first elastic return means; and
- a high unlocking position for unlocking the braking ring, the movement of the dual function control member from the nominal central position to the high unlocking position causing said disengagement element to move the locking member against the strain exerted by said second elastic return means, until the braking ring is released.

The invention improves the pipette ergonomics by providing a dual function control member, substituting for two distinct members provided in the solutions of prior art. Safety is added to the simplicity provided by the invention, since the locking position of the locking member is achieved in a nominal central position of the dual function member, that is when no strain is applied on the latter by the operator. Undesired misadjustment risks of the volume to be sampled are thus reduced to zero.

As appears from above, blocking the volume adjusting control screw is not produced by an operator's strain, but results from the strain exerted by the second elastic return means. Consequently, the screw braking strain is constant and independent of the operator's force, unlike pipettes of prior art.

Finally, it is noted that the design offered by the present invention only requires the utilisation of a single hand for actuating the dual function control member, regardless of whether it is to reach the low cone ejection position, to reach the high unlocking position, or even to join the nominal central position in any of the last two positions. This provides a particularly satisfactory ergonomics.

The invention has on the other hand at least any of the following optional characteristics, taken alone or in combination.

The pipette is configured such that the high unlocking position for unlocking the braking ring is a balance position maintained by friction between said disengagement element and the locking member. Thanks to this balance position, the operator can carry cut the adjustment of the volume to be sampled without having to provide any strain for maintaining the control member in the high unlocking position.

Said disengagement element is a pivoting finger.

Said locking member includes:

- a ring arranged facing axially a collar of the braking ring, a first end pivotally mounted to a fixed element of the pipette, as well as a second end opposite to the first one and for cooperating with said disengagement element, such that the second end and this disengagement element respectively form a cam and a cam follower.

In this case, the first end is pivotally mounted about an off-centre axis of rotation, arranged in a transverse plane of the pipette. Thanks to this eccentricity and the pivoting nature of the locking member, the latter acts as a lever arm upon moving the control member to the high unlocking position. The strain to be applied by the operator on the dual function control member is thus lower than the strain exerted by the second elastic return means, which further improves ergonomics and reduces musculo-skeletal trouble risks.

Preferably, a friction washer is interposed between said collar and the ring of the locking member.

Said following means comprise at least one toothed angular sector rotatable about an axis of rotation of the following means, the toothed angular sector cooperating with a rack provided on said dual function control member, the toothed angular sector being rotatably integral with said disengagement element. In addition, in the high unlocking position of the braking ring, the balance position is maintained by friction between the second end and the disengagement element, the friction strain being oriented with a non-zero component along the tangential direction relative to said axis of rotation of the following means. Consequently, simply pressing leaning downwardly the control member is sufficient to break this balance position, and to return the latter in the nominal central position.

Further, the pipette is configured such that in the high unlocking position of the braking ring, said dual function control member acts as an axial stop for the pipetting control knob in its downward stroke, and such that the axial movement of the dual function control member caused by the axial movement of the pipetting control knob, generates, before the end of a purge stroke, a break in said balance position after which said locking member is automatically moved towards its locking position, under the effect of the strain exerted by the second elastic return means.

This functionality first enables the pipetting control knob to be used rather than the dual function control member to return the same in the nominal central position, wherein the volume adjusting system is blocked. Consequently, this functionality also makes sure that the volume adjusting system is blocked after the first purge stroke, in the hypothesis where the operator would have forgotten to conduct such a locking via the dual function control member.

Preferably, the pipette is configured such that the volume adjusting control screw is rotatably driven by the control rod.

Preferably, the cone ejector includes an ejection rod returned in a high position by the first elastic return means, as well as a low ejection part integral with a low end of the ejection rod.

Preferably, said dual function control member is equipped with stop means enabling its upward stroke relative to the fixed pipette body to be limited.

Finally, the pipette is a single channel or multichannel pipette.

Further advantages and characteristics of the invention will appear in the detailed non-limiting description below.

BRIEF DESCRIPTION OF THE DRAWINGS

This description will be made with regard to the appended drawings in which.

DETAILED DESCRIPTION OF PREFERRED EMBODIMENTS

Figure 1:
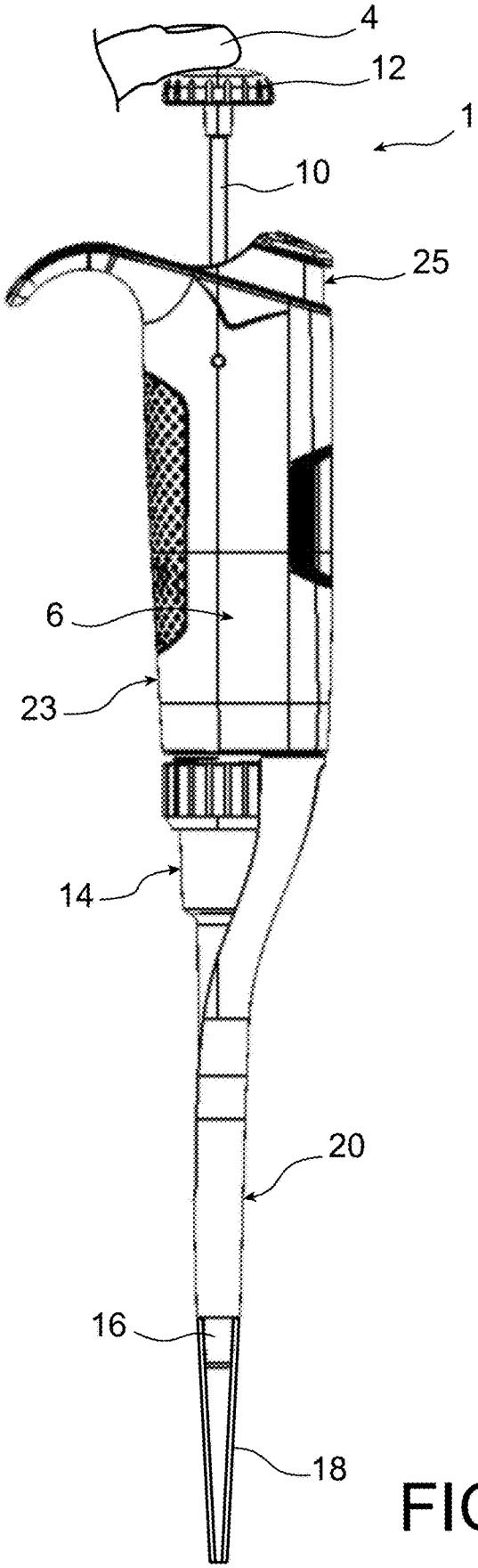
FIG. 1 represents a front view of a manually actuated sampling pipette according to the present invention, with its dual function control member arranged in a nominal central position.

In reference to FIG. 1, a manually actuated sampling pipette 1 is represented, for being handheld by an operator which, using his/her thumb 4, is capable of actuating the pipette to generate dispensing a liquid which has been drawn beforehand.

More precisely, the pipette 1 comprises a handle 6 forming an upper body of the pipette, handle from which a control rod 10 opens, carrying at its high end, in a pipetting position, a pipetting control knob 12 the upper part of which is for undergoing the pressure of the operator's thumb. By way of indicating purposes, it is noted that a display screen (not represented) can be provided on the handle 6.

Under the handle 6, the pipette 1 includes a removable low part 14, which downwardly ends by a cone-holder tip 16 receiving a consumable 18, also called a sampling cone.

A cone ejector 20 downwardly opens into the handle 6. As will be mentioned hereinafter, the ejector can be moved relative to the handle 6 and the low part 14, both forming the fixed body 23 of the pipette.

One of the features of the invention, which will be detailed hereinafter, lies in implementing a dual function control member 25, which enables the unlocking function of the sampling volume adjusting system, and the cone ejection function to be alternatively ensured. In this regard, it is noted that in the embodiment described and represented in the figures, this is a single channel pipette carrying a single consumable 18. However, it could be a multichannel pipette carrying several cones, without departing from the scope of the invention.

Figure 2:
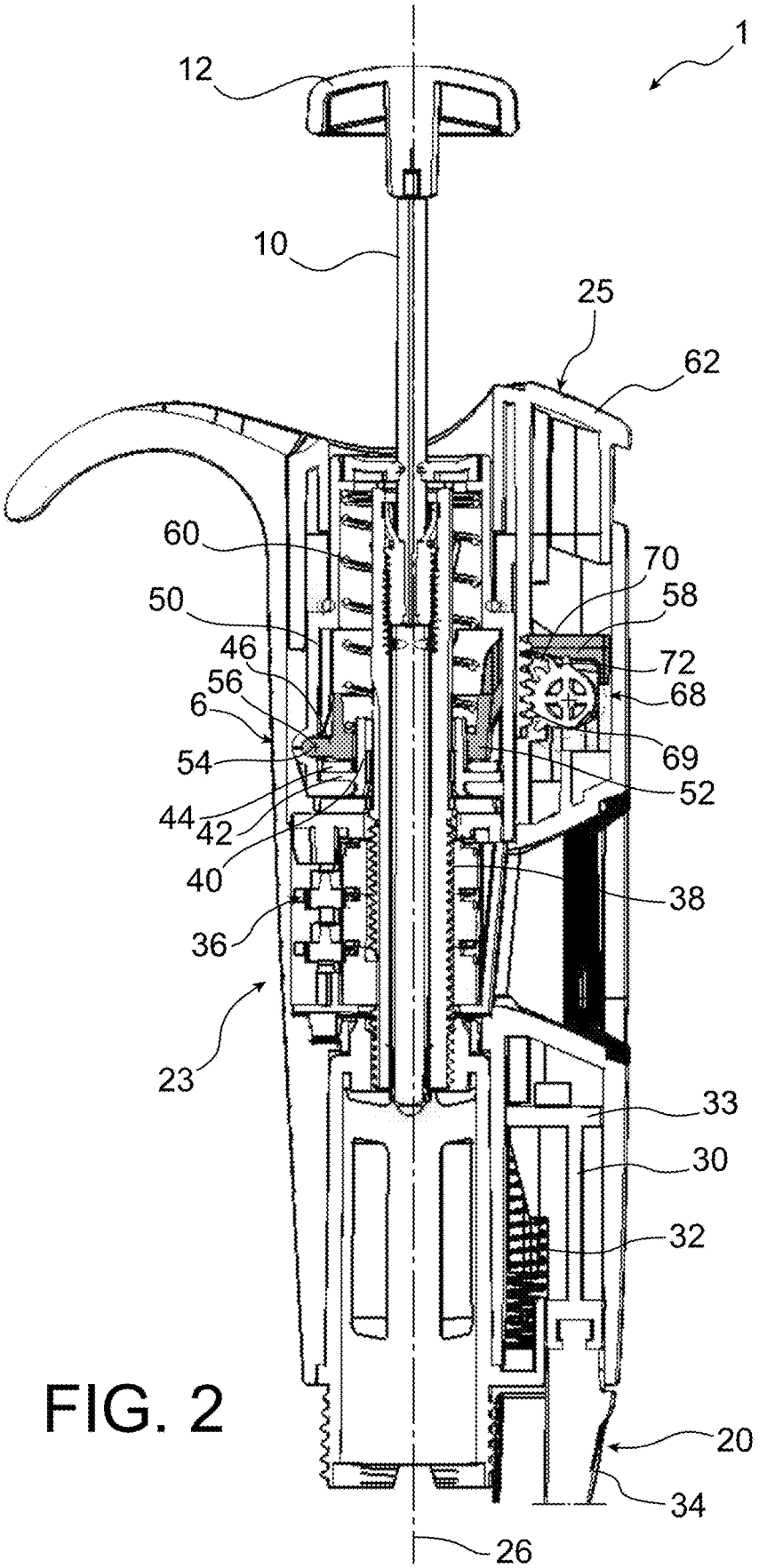
FIGS. 2 and 3 are axial cross-section enlarged views of the pipette shown in the preceding Fig., along two distinct axial cross-section planes.
Figure 3:
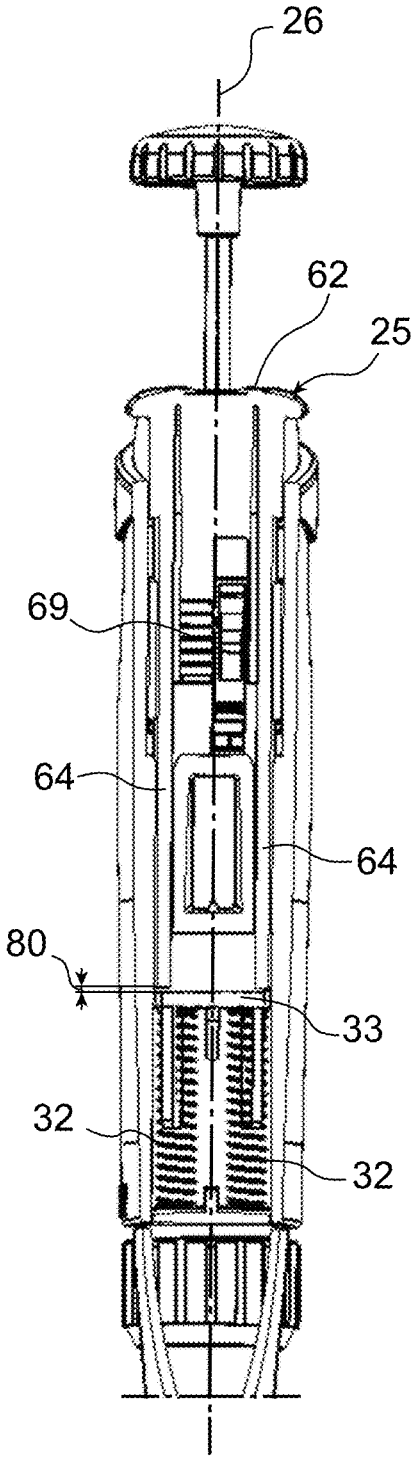

In reference to FIGS. 2 and 3, the high part of the pipette 1 is represented, with a longitudinal axis 26.

In the low part of the handle 6, this houses a part of the cone ejector 20. This is an ejection rod 30 returned in the high position by first elastic return means, preferably one or more compression springs 32. The springs 32 act on a tray 33 attached to the high end of the rod 30. At its low end, the rod 30 is integral with a low ejection part 34 which conveys outside the fixed body 23, along and around the low part (as is visible in FIG. 1).

Around the pipetting control rod 10, the pipette is equipped with a system 36 for adjusting the volume to be sampled, being housed inside the handle 6. This system 36 includes, upstream of the kinematic chain, a sampling volume adjusting control screw. This screw 38 is rotatably integral, about the axis 26, with a braking ring 40 arranged around the screw 38, through which the control rod 10 passes. Thus, in a known manner per se, adjusting the volume to be sampled is made by the operator by rotating the knob 12, which causes the rotation of the control rod 10, that of the screw 38, and then that of the braking ring 40. Simultaneously and mainly, the rotation of the screw 38 drives a downstream part of the kinematic chain of the adjusting system 36, the actuation of which enables the volume which will then be sampled to be varied.

The braking ring 40 is centred on the axis 26 and includes a peripheral end in the form of a collar 42, which extends in a transverse plane of the pipette. The upper surface of the collar 42 supports a friction washer 44 of elastomer, upwardly facing a member 46 for locking the braking ring 40.

Figure 6:
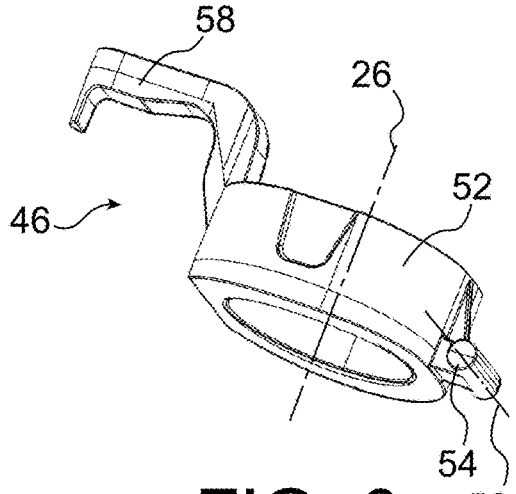

The locking member 46, also represented in FIG. 6, is housed in a fixed hollow element 50, itself housed in the handle 6. It includes a ring 52 arranged axially downwardly facing the friction washer 44. In addition, it includes a first end 54 pivotally mounted to the fixed element 50, about an axis of rotation 56 which is off-centred with respect to the axis 26, and arranged in a transverse plane of the pipette so as to be substantially orthogonal to the same axis 26. The axis of rotation 56 is preferably substantially tangent relative to the handle 6. The locking member 46 also comprises a second end 58 opposite to the first end 54, that is arranged diametrically opposite to the ring 52.

The pipette also includes second elastic return means, made by one or more compression springs 60 the high end of which presses a high part of the fixed hollow element 50, and the low end of which presses the ring 52, and more precisely on a shoulder provided inside the same.

The spring 60 thus forces the locking member 46 to be pressed against the friction washer 44, and thus against the collar 42 of the braking ring which supports the same washer 44.

Figure 4:
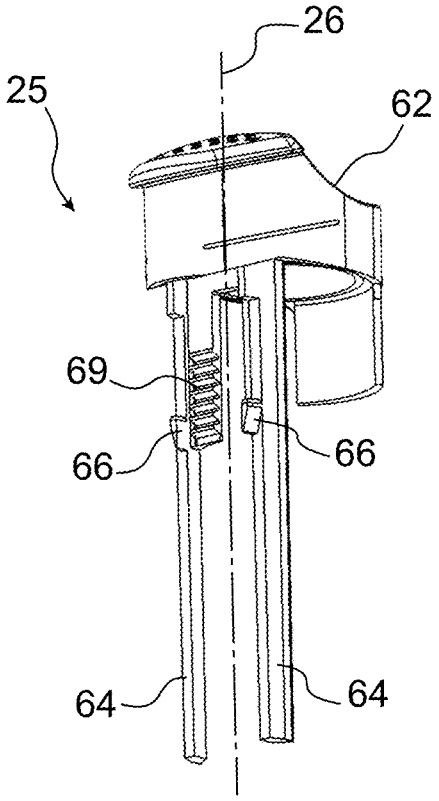
FIGS. 4 to 6 represent in perspective views different elements of the pipette shown in the preceding figures.

As previously indicated, the pipette further comprises the dual function control member 25, also represented in FIG. 4. This member 25 specific to the invention includes a high actuating portion 62 projecting outwardly of the handle 6, and on which the operator can act with his/her thumb when he/she grips the pipette. The actuating portion 62 is downwardly extended by two axial leaning tabs 64, each equipped with an axial stop tooth 66 provided to limit its upward stroke with respect to the fixed body 23 in which the member 25 is axially slidingly mounted. The axial tabs 64 convey inside the handle 6 and their low ends are facing the tray 33 of the cone ejector, as is more visible in FIG. 3. Finally, one of both tabs 64 is equipped with an axially extending rack 69.

Figure 5:
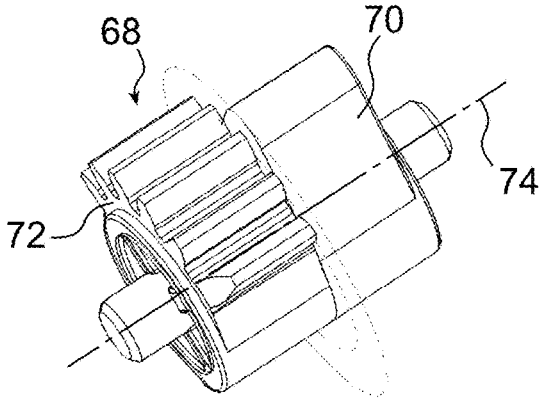

The pipette 1 is also equipped with following means for following the axial movement of the dual function control member 25, these following means 68 being also represented in FIG. 5. They are housed in the handle 6, and include a disengagement element 70 for disengaging the locking member 46, for cooperating with a lower surface of the second end 58. The disengagement element 70 is preferentially a pivoting finger, whereas the lower surface of the second end 58 has a slope with respect to a transverse plane of pipette, such that these elements 70, 58 form a cam and a cam follower respectively.

Further, the following means 68 comprise a toothed angular sector 72, for example extending on substantially 90°. This sector 72, as the finger 68 rotatably integral with the latter, are rotatably mounted to the handle 6 about an axis of rotation 74 arranged in a transverse plane of the pipette, and preferably parallel to the axis of rotation 56 of the locking member 46. The toothed angular sector 72 meshes with the rack 69 of the dual function control member 25.

Figure 7A:
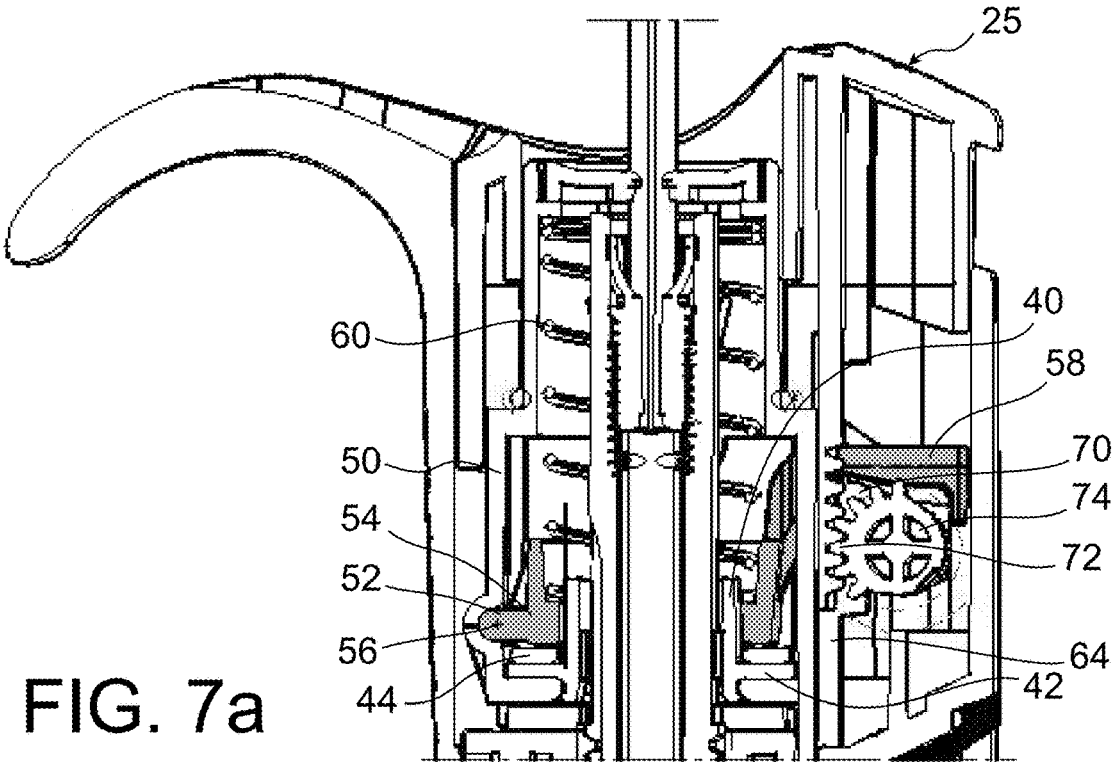
FIGS. 7*a* and 7*b* represent in an enlarged manner a high part of the pipette shown in the preceding figures.
Figure 7B:
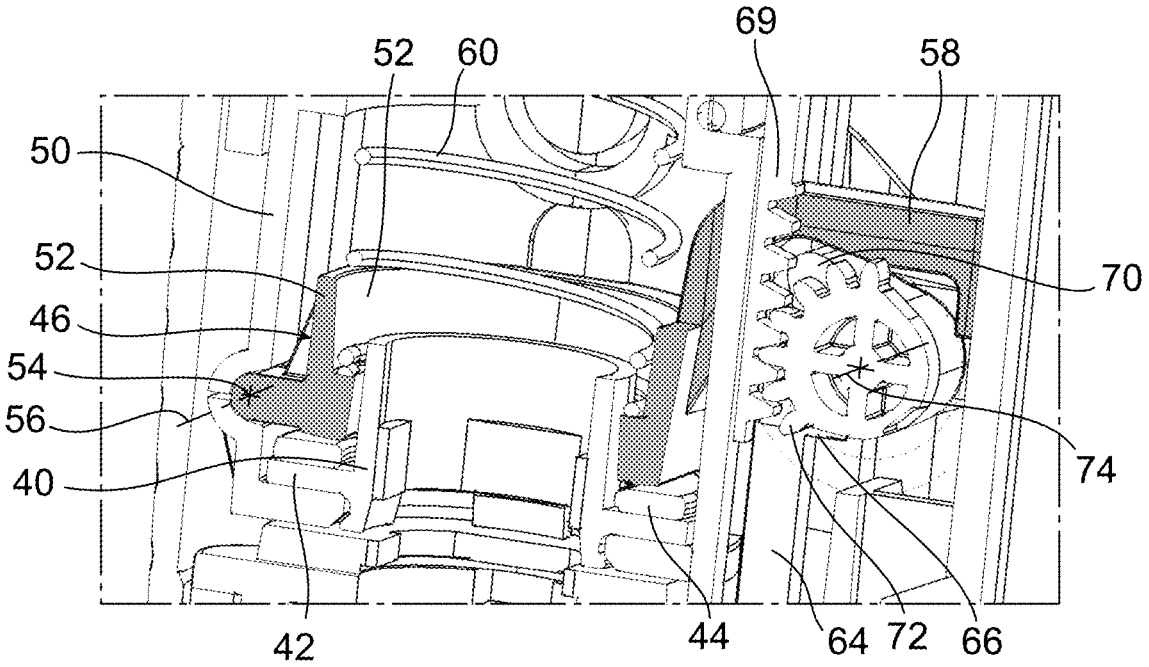

In the figures described previously, the control member 25 occupies a nominal central position with respect to the handle 6, this position being a balance position when no action is performed by the operator on this member 25. In this nominal central position also represented in FIGS. 7*a* and 7*b*, the spring 60 exerts a strain which returns the locking member 46 into a locking position, in which the ring 52 is pressed against the collar 42 of the braking ring 40. More precisely, the strain exerted by the spring 60 causes the member 46 to downwardly pivot from its first hinged end 54, to abut against the friction washer 44 supported by the collar 42.

Because of the friction strain exerting on both elements 52, 42 through the washer 44, the braking ring 40 remains rotatably blocked, which causes the sampling volume adjusting system to be locked.

Consequently, in this nominal central position of the control member 25, the operator can make pipetting operations with the knob 12 and the rod 10, without risk of modifying the adjustment of the volume to be sampled. Still in the same position, the finger 70 remains remote from the second end 58 of the locking member, whereas the tabs 64 are spaced apart from the tray 33 of the ejector 20 by a small axial clearance 80, referenced in FIG. 3.

From this nominal central position, the control member 25 can be moved by the operator's thumb either upwardly in a high unlocking position of the braking ring 40, or downwardly in a low cone ejection position.

Figure 8A:
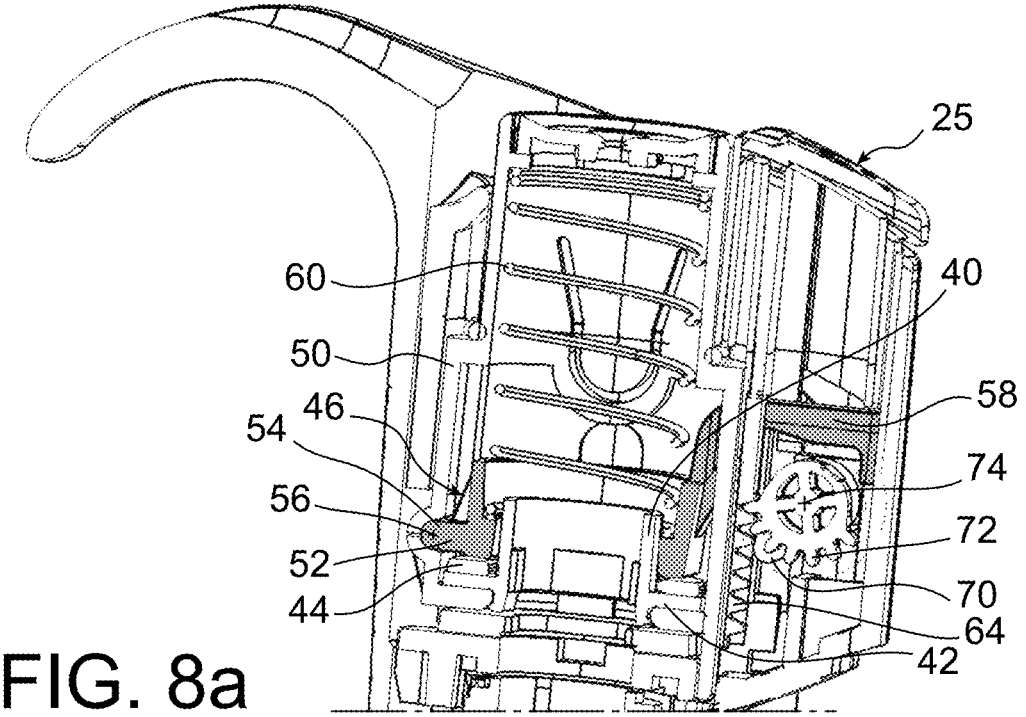
FIGS. 8*a* and 8*b* represent analogous views to those of FIGS. 7*a* and 7*b*, with the dual function control member being in the low cone ejection position.
Figure 8B:
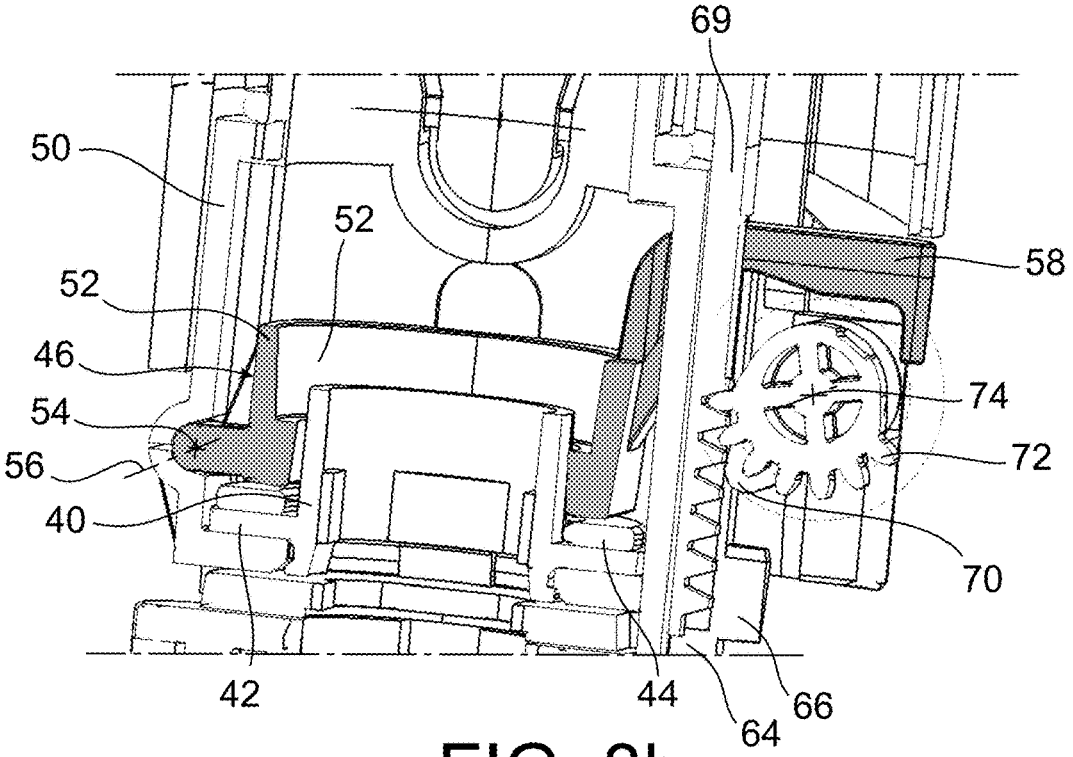
Figure 8C:
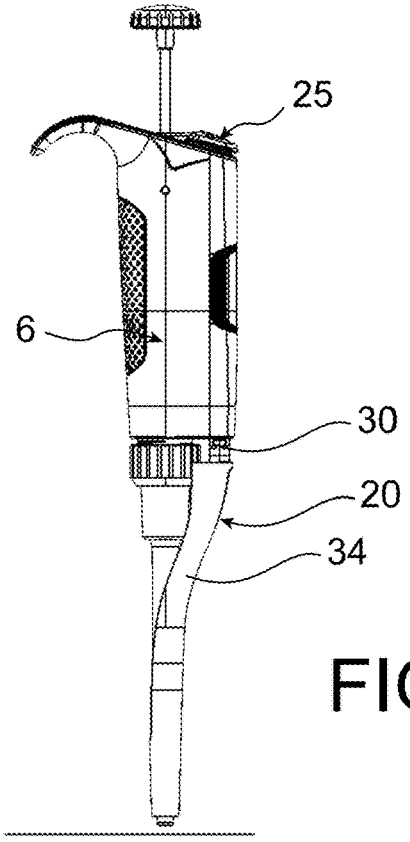
FIG. 8*c* represents a view similar to that of FIG. 1, with its dual function control member being in the low cone ejection position.

In reference first to FIGS. 8*a* to 8*c*, the low cone ejection position is shown, in which the control member 25 presses the tray of the cone ejector 20, via the low end of its tabs 64. As the operator's thumb presses downwardly on the member 25, the axial clearance 80 shown in FIG. 3 is first quickly consumed, and then the tabs 64 come in contact with the tray 33. Continuing the actuation of the control member 25 is made against the strain exerted by the springs 32, and thus by pushing back the entire ejector 20 downwardly. The ejection rod 30 thereby comes partly out of the handle 6, as is shown in FIG. 8*c*. This motion thus causes the cone ejector 20 to be downwardly moved by pressing the cone, until the same is ejected.

The movement of the member 25 from the nominal central position to this low position does not cause any movement of the locking member 46, which preserves its locking position thanks to the pressing strain exerted by the spring 60. Consequently, during this cone ejection operation, adjusting the volume to be sampled is not modified.

Further, during the same movement of the control member 25 downwardly, the rack 69 meshes with the toothed sector 72, but the pivoting finger 70 does not contact the second end 58 of the locking member 46. Indeed, this finger downwardly swings at the same time as the control member 25 goes down, because the toothed sector 72 rotatably drives it. During the movement between the nominal central position and the low cone ejection position, the strain of the spring 60 onto the locking member 46 remains constant.

After the cone is ejected and the operator's pressure onto the control member 25 is released, the latter returns to the nominal central position by virtue of the return strain exerted by the springs 32.

Figure 9A:
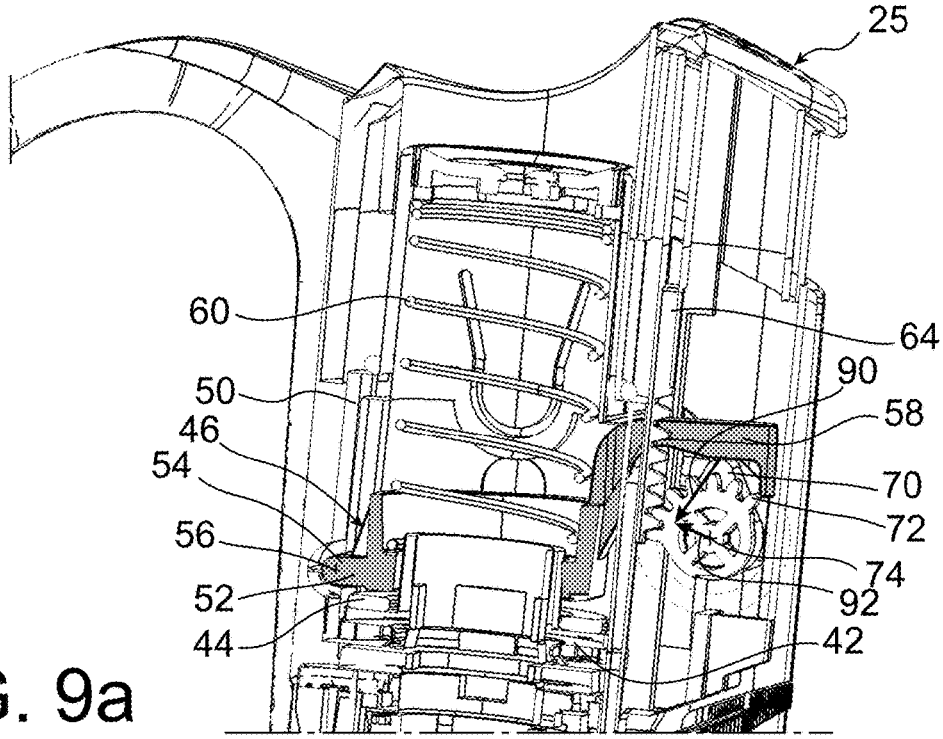
FIGS. 9*a* to 9*c* represent analogous views to those of FIGS. 8*a* to 8*c*, with the dual function control member being in the high unlocking position of the braking ring.
Figure 9B:
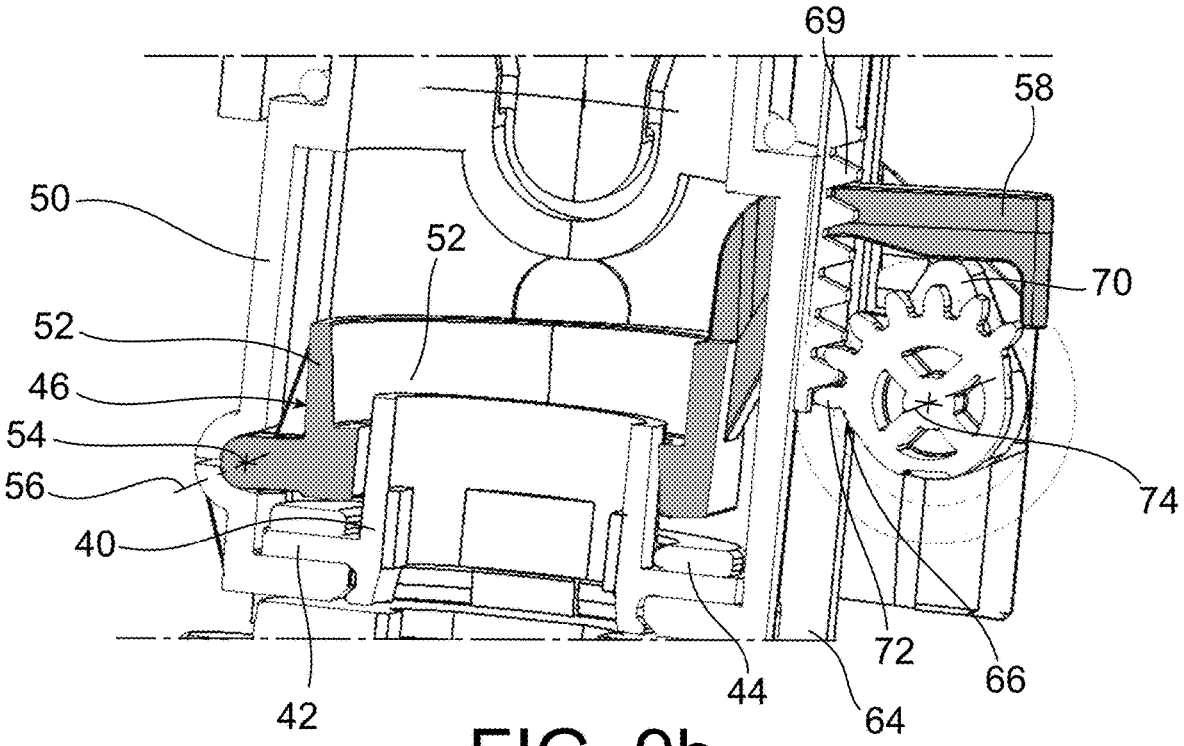
Figure 9C:
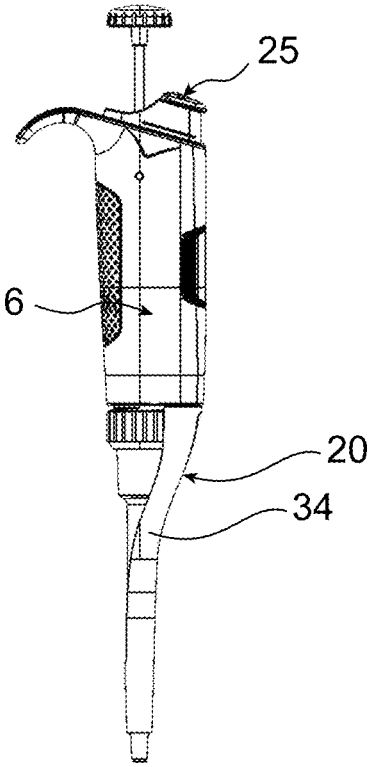

In reference now to FIGS. 9*a* to 9*c*, the high unlocking position of the braking ring 40 is shown, position in which this ring can freely rotate, and thus accompany the rotation of the control rod 10 applied via the knob 12 by the operator, to adjust the volume to be sampled.

As the member 25 moves upwardly from its nominal central position, the rotation of the toothed sector 72 driven by the axial motion of the tabs 64 causes the finger 70 to upwardly pivot, until it contacts the second end 58 of the locking member 46. From this contact, both elements 70, 58 fulfil their cam and cam follower function, respectively.

As the rise of the member 25 is continued under the effect of the action exerted by the operator, the pivoting finger 70 causes the second end of the locking member 46 to be lifted, causing a rotation thereof about its axis of rotation 56. This rotation of the member is made against the strain exerted by the spring 60, but with an operator's actuating force which is advantageously much lower than that of the spring 60, because of the lever arm effect which is noticed. The upward pivoting of the locking member 46 causes it to decrease the axial pressure it exerts on the collar 42 via the washer 44, until the braking ring 40 is released. This release is materialised by an absence of axial pressure between both elements 52, 42, or by the conservation of a very low pressure which does not prevent the braking ring 40 from rotating upon adjusting the volume by the operator.

The upward movement of the dual function control member 25 is stopped by its axial stop teeth 66, which contact corresponding fixed elements (not represented) of the fixed body 23. Once the high unlocking position is reached, in spite of the significant strain exerted by the compressed spring 60, this position is self-maintained by the friction between the rotatable finger 70 and the second end 58 of the locking member 46. By virtue of this balance state, the operator can release the control member 25 which remains in the high position, to then rotate the control knob 12 and conduct adjusting the volume to be sampled.

The friction strain 90 between the cam 70 and the cam follower 58, which maintains the balance position, is oriented with a non-zero component 92 along the tangential direction relative to the axis of rotation 74. Consequently, after adjusting the volume to be sampled, the operator can exert a simple downward pressure on the control member 25 in order to oppose to this friction strain 90, and break this balance position. The balance is thus broken after a very small downward stroke of the control member 25. After this break, the operator can continue the descent of the control member 25 until it returns to its nominal central position. Simultaneously, the locking member 46 is automatically and abruptly moved downwardly towards its locking position, under the effect of the strain exerted by the spring 60 pressing the ring 52 of this locking member 46.

Figure 10:
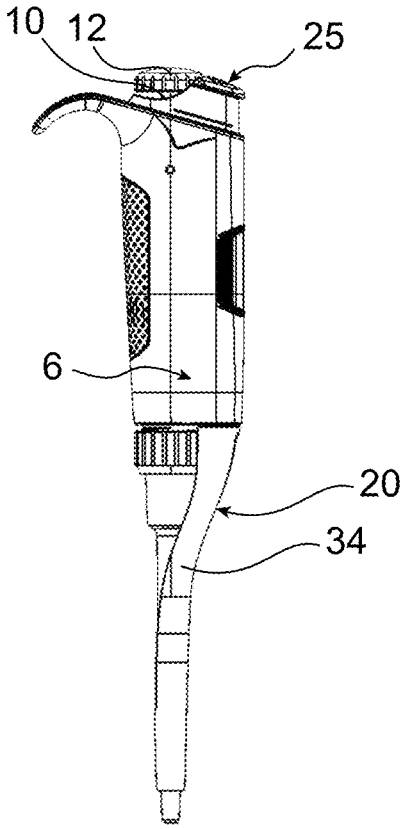
FIG. 10 represents a view similar to that of FIG. 1, with its dual function control member being in the high unlocking position of the braking ring, during a purge stroke of the control rod.

In reference now to FIG. 10, it is noted that when the control member 25 is in the high unlocking position, it acts as an axial stop for the control knob 12 during its downward stroke. This turns out to be particularly interesting when the operator forgets to return the member 25 into the nominal central position, after he/she has made an adjustment of the volume to be sampled.

Indeed, during a descent of the control rod 10 and after the dispensing stroke, the knob 12 contacts the high end of the member 25 which is thereby downwardly slidingly driven with the same knob 12.

After a small axial movement of the control member 25, and before the end of a purge stroke of the knob 12, a break in the balance position of the cam 70 and the cam follower 58 is created, for the same reason as that set out above in the case of a voluntary movement of the member 25 by the operator.

Consequently, after this break in the balance position, the locking member 46 returns automatically to its locking position by virtue of the strain exerted by the spring 60. Simultaneously, continuing the purge stroke with the control knob 12 continues to generate a downwardly slide of the dual function control member 25, because of the preservation of the axial stop between both these elements 12, 25. In addition, when the knob 12 arrives at its end of purge stroke, the dual function control member 25 preferentially occupies its nominal central position. Thereby, if the operator forgets it, this nominal central position is automatically returned to after the first downward stroke of the control rod 10 and of its associated control knob 12.

Then, releasing the control knob 12 results in the control rod 10 automatically lifting in a known manner per se which will not be further described, whereas the dual function control member 25 in turn remains in its nominal central position.

Of course, various modifications can be provided by those skilled in the art to the invention just described, only by way of non-limiting examples.

The invention claimed is:

1. A manually actuated sampling pipette comprising:

a fixed pipette body having a longitudinal axis defining an axial direction;

a pipetting control rod extending from the fixed pipette body;

a pipetting control knob disposed at a distal end of the pipetting control rod;

first elastic return means disposed in the fixed pipette body;

a cone ejector biased into an upper position with respect to the fixed pipette body by said first elastic return means;

a sampling volume adjusting control screw disposed in the fixed pipette body;

a braking ring for braking the control screw, said braking ring being rotatably integral with the control screw;

a dual function control member allowing an unlocking control of the braking ring and a cone ejection control, the control member being slidingly mounted relative to the fixed pipette body for axial movement along the axial direction;

a locking member for locking the braking ring;

second elastic return means for biasing the locking member into a locking position wherein the second elastic return means cooperates with the braking ring to brake the rotation of the braking ring; and following means for following the axial movement of the dual function control member, the following means including a disengagement element for disengaging the locking member, wherein the control member has a nominal central position wherein said second elastic return means biases the locking member into the locking position and the control member is configured to be selectively movable axially from the nominal central position, to:

a cone ejection position, in which the control member presses the cone ejector, wherein the axial movement of the dual function control member from the nominal central position to the cone ejection position is made against a strain exerted by said first elastic return means; and a unlocking position for unlocking the braking ring, wherein the axial movement of the dual function control member from the nominal central position to the unlocking position causes said disengagement element to move the locking member against a strain exerted by said second elastic return means, to release the braking ring.

2. The pipette according to claim 1, wherein the unlocking position for unlocking the braking ring defines a balance position wherein a force created by friction between said disengagement element and the locking member equals the strain exerted by said second elastic return means.

3. The pipette according to claim 1, wherein said disengagement element is a pivoting finger.

4. The pipette according to claim 1, wherein
the braking ring includes a collar, and
said locking member includes:
a ring arranged facing axially the collar of the braking ring,
a first end pivotally mounted to a fixed element in the fixed pipette body, and
a second end opposite to the first end, the second end cooperating with said disengagement element of the following means, wherein the second end and the disengagement element define a cam and cam follower arrangement.

5. The pipette according to the claim 4, wherein the first end of the locking member is pivotally mounted about an off-centre axis of rotation that extends in a plane transverse to the longitudinal axis of the fixed pipette body.

6. The pipette according to claim 4, wherein a friction washer is interposed between said collar and the ring of the locking member.

7. The pipette according to claim 1, further comprising:
a rack on said dual function control member, and
said following means comprising at least one toothed angular sector rotatable about an axis of rotation of the following means, the toothed angular sector cooperating with the rack on said dual function control member, the toothed angular sector being rotatably integral with said disengagement element of said following means.

8. The pipette according to claim 2, further comprising:
a rack on said dual function control member, and
said following means comprising at least one toothed angular sector rotatable about an axis of rotation of the following means, the toothed angular sector cooperating with the rack on said dual function control member, the toothed angular sector being rotatably integral with said disengagement element of said following means,
wherein in the unlocking position of the braking ring, the balance position is maintained by friction between a second end of the locking member and the disengagement element, and the force created by friction has a non-zero component in a direction tangential to said axis of rotation of the following means.

9. The pipette according to the claim 8, wherein in the unlocking position of the braking ring, said dual function control member acts as an axial stop for the pipetting control knob during a downward stroke of the pipetting control knob, and wherein before an end of a purge stroke the axial movement of the dual function control member caused by an axial movement of the pipetting control knob allows the second elastic return means to move said locking member towards the locking position.

10. The pipette according to claim 1, wherein the volume adjusting control screw is rotatably driven by the control rod.

11. The pipette according to claim 1, wherein the cone ejector includes:
an ejection rod biased into an upper position by the first elastic return means and
an ejection part integral with a lower end of the ejection rod.

12. The pipette according to claim 1, wherein said dual function control member comprises:
stop means for limiting an upward stroke of the dual function control member relative to the fixed pipette body.

13. The pipette according to claim 1, wherein said dual function control member allows for cone ejection control of a single cone or multiple cones.

* * * * *